US005458259A

United States Patent [19]

Falk

[11] Patent Number: 5,458,259

[45] Date of Patent: Oct. 17, 1995

[54] TRASH RECEPTACLE BASE WITH LINER DISPENSER

[76] Inventor: Lee R. Falk, 5004 The Riviera, Tampa, Fla. 33609

[21] Appl. No.: 357,219

[22] Filed: Dec. 13, 1994

[51] Int. Cl.[6] ..... G07F 11/02

[52] U.S. Cl. ..... 221/22; 221/25; 221/28; 221/34; 221/46; 221/61; 221/97; 220/407; 220/408

[58] Field of Search ..... 221/22, 25, 26, 221/27, 28, 33, 34, 46, 61, 63, 66, 92, 97, 199; 220/407, 908, 406; 206/390, 395, 494, 554

[56] References Cited

U.S. PATENT DOCUMENTS

| | | | |
|---|---|---|---|
| 3,300,082 | 1/1967 | Patterson . | |
| 3,451,453 | 6/1969 | Heck . | |
| 3,800,503 | 4/1974 | Maki | 220/407 X |
| 4,319,694 | 3/1982 | Nehrbass et al. | 220/908 X |
| 4,721,226 | 1/1988 | Yurko | 220/407 |
| 4,850,507 | 7/1989 | Lemongelli et al. | 220/487 |
| 4,955,505 | 9/1990 | Battaglia | 220/407 |
| 5,031,793 | 7/1991 | Chen et al. | 220/908 X |
| 5,115,935 | 5/1992 | Lemongelli | 220/407 |
| 5,183,157 | 2/1993 | Darden | 206/390 |
| 5,294,017 | 3/1994 | Li | 220/407 |
| 5,322,180 | 6/1994 | Ker | 220/407 |

FOREIGN PATENT DOCUMENTS

| | | | |
|---|---|---|---|
| WO9405567 | 3/1994 | WIPO | 220/407 X |

*Primary Examiner*—William E. Terrell
*Assistant Examiner*—Dean A. Reichard
*Attorney, Agent, or Firm*—Shoemaker and Mattare, Ltd.

[57] ABSTRACT

A magazine for dispensing liner bags from a supply roll through an aperture in the bottom of a trash receptacle includes an upwardly open base having a horizontal cross-sectional shape adapted to receive the trash receptacle, a hinge for connecting the base to the trash receptacle along a horizontal pivot axis extending along one side of the base, whereby the receptacle can be tilted away from the base to provide access to the base. The base has a seat formed by an inwardly protruding flange to limit the depth of penetration of the trash receptacle into the magazine, so that it does not bear against or otherwise interfere with the liner bag supply. Two parallel dividers in the base form three compartments. The outer compartments are useful for storing addition supply rolls or supplies, while the central one contains the active supply roll.

4 Claims, 3 Drawing Sheets

TRASH RECEPTACLE BASE WITH LINER DISPENSER

BACKGROUND OF THE INVENTION

This invention relates generally to waste containers, and more particularly to a magazine which dispenses plastic film bag liners, one at a time, through a slot in the bottom of the receptacle.

Many people prefer to protect a trash receptacle with a plastic bag liner, before placing trash in the receptacle. The liner improves sanitation, and can be easily removed from the receptacle, with the trash.

Trash receptacle liners, sold in a box, may be kept in a drawer for use as the occasion requires. One sometimes has to search for the box in order to replace the liner. It would be more convenient to keep liners within the receptacle itself, and some prior inventors have developed magazines or the like which are part of, or are associated with, the receptacle.

U.S. Pat. No. 5,183,157 discloses a container which holds plastic bags that are linked together in series, and can be pulled from the container one at a time. The container is intended to be placed in the bottom of a standard trash receptacle, although not permanently affixed to it. U.S. Pat. No. 4,721,226 is similar, except that the box is inserted laterally into the receptacle through an opening in the bottom of the receptacle.

U.S. Pat. No. 4,850,507 discloses a trash container having a base provided with a special recess which receives a box of liner bags. U.S. Pat. No. 3,451,453 places a horizontal partition near the bottom of a trash receptacle, so as to provide a lower compartment. Liner bags, which may be wound in a roll initially, are withdrawn through a slot in the partition as needed. U.S. Pat. No. 3,800,503, No. 4,955,505, and No. 3,300,082 show other roll-type magazines.

The known devices may work perfectly well as long as liner bags remain in the magazine, but when the magazine is empty, replacement of the liner bag supply may be difficult or inconvenient.

SUMMARY OF THE INVENTION

An object of the invention is, therefore, to improve the ease with which one can replace liner bag supplies in a trash receptacle of the type described above.

Another object of the invention is to utilize space in a liner bag magazine, which would otherwise be wasted, for storage of additional liner bags.

These and other objects are attained by a magazine for dispensing liner bags from a supply roll through an aperture in the bottom of a trash receptacle including an upwardly open base having a horizontal cross-sectional shape adapted to receive the trash receptacle, a hinge for connecting the base to the trash receptacle along a horizontal pivot axis extending along one side of the base, whereby the receptacle can be tilted away from the base to provide access to the base. The base has a seat formed by an inwardly protruding flange to limit the depth of penetration of the trash receptacle into the magazine, so that it does not bear against or otherwise interfere with the liner bag supply. Two parallel dividers in the base form three compartments. The outer compartments are useful for storing addition supply rolls or supplies, while the central one contains the active supply roll.

BRIEF DESCRIPTION OF THE DRAWINGS

In the accompanying drawings.

DESCRIPTION OF THE PREFERRED EMBODIMENT

Figure 1:
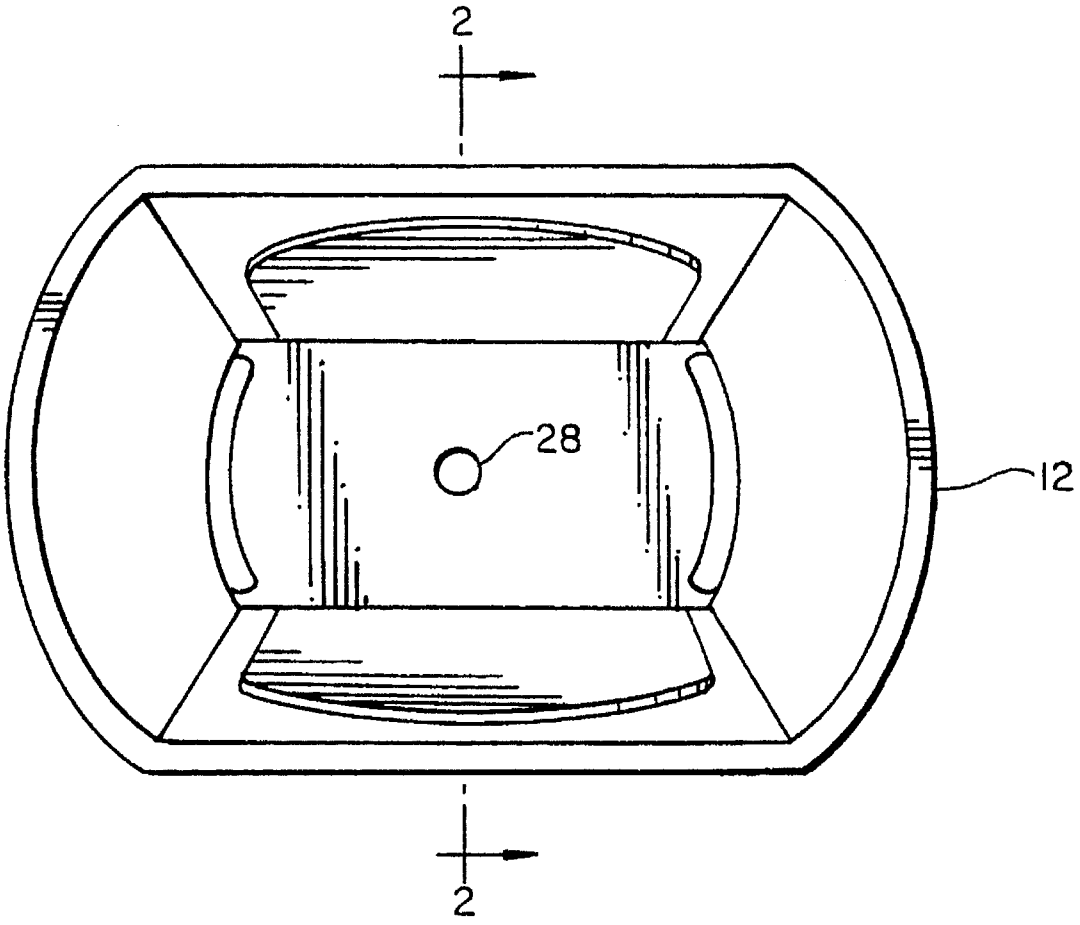
FIG. 1 is a top plan view of a trash receptacle base with liner bag dispenser embodying the invention.
Figure 2:
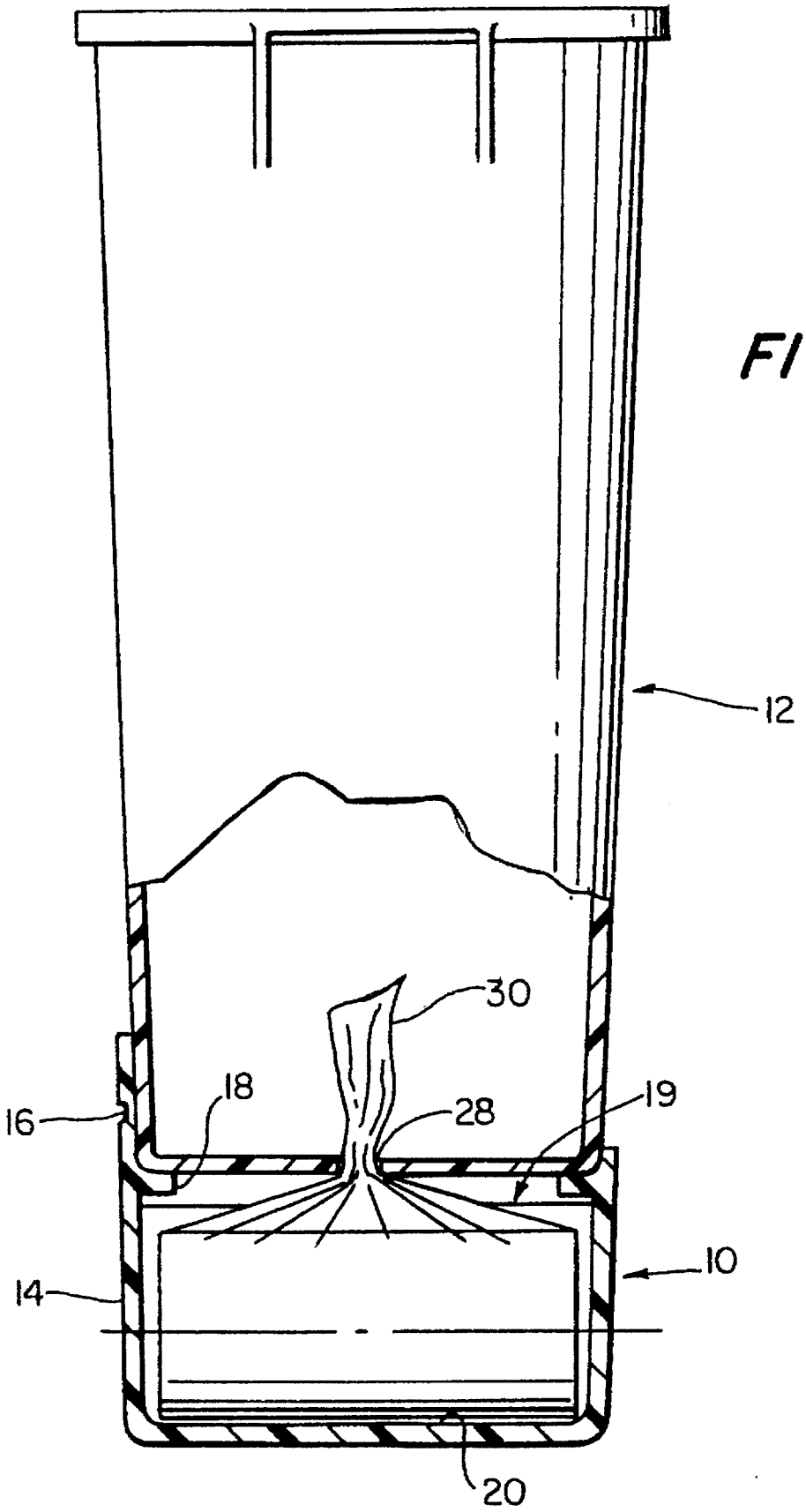
FIG. 2 is a sectional view taken on the vertical plane 2—2 in FIG. 1.
Figure 3:
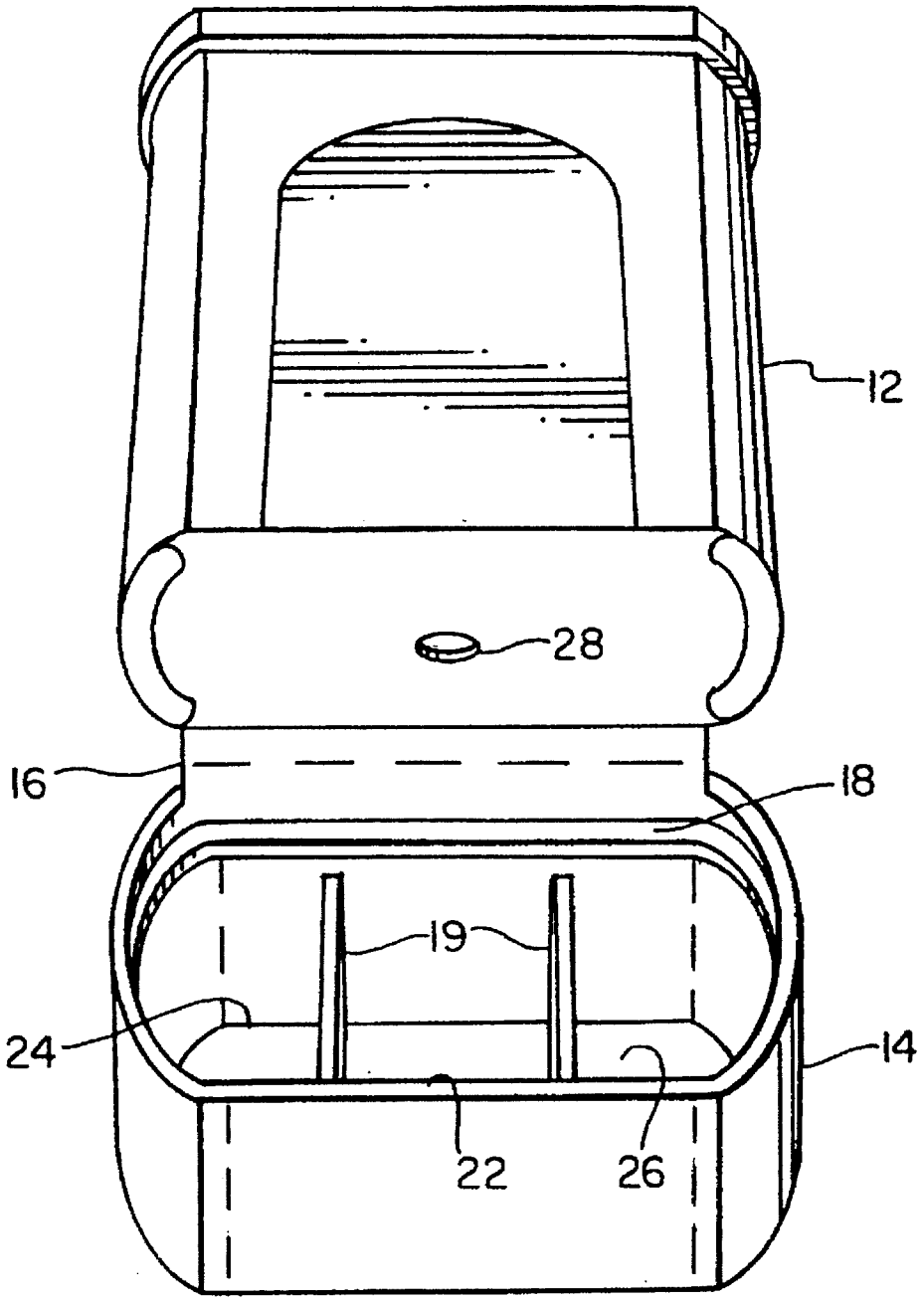
FIG. 3 is a perspective view of the invention, showing the trash receptacle proper tipped to provide access to the liner bag magazine.

A magazine 10 for dispensing liner bags for a trash receptacle 12, as shown in FIGS. 1–4, includes an upwardly open base 14 whose horizontal cross-sectional shape (FIG. 3) is preferably like that of the trash receptacle 12.

The base, which may be molded of a hard rubber, or any suitable polymeric material, is connected to the trash receptacle by a hinge 16 having a horizontal pivot axis extending, preferably, along one of the longer sides of the base. The hinge may be integrally formed with the base, and connected to the trash receptacle by rivets, welding, or any other means. The hinge may be a "living" hinge with a linear zone of reduced thickness to provide a bending locus, or a more conventional "piano" hinge.

The base has a seat formed by an inwardly protruding flange 18, to limit the depth of penetration of the trash receptacle into the magazine, so that it does not bear against or otherwise interfere with the liner bag supply.

Two vertical, parallel dividers 19 extend upward from the floor 20 of the base, arranged equidistant from the center plane 2—2. Between them is a central cavity 22 slightly larger in each direction that the size of a full roll of liner bags. Auxiliary cavities 24, 26, on either side of the central cavity, provide convenient storage for additional rolls of liner bags, or perhaps for cleaning implements or fluids, and bag ties.

An important function of the dividers is to prevent the supply roll from spinning or twisting, about a vertical axis, as bags are drawn from it.

A hole 28 is formed in the bottom center of the trash receptacle proper, and the leading bag 30 from the roll is inserted through it from the bottom, when the roll is first installed (FIG. 4). Thereafter, the leading bag is pulled up into the trash receptacle, and stretched over the edge of the receptacle. When the bag is full of trash, and is simply lifted out of the receptacle, it draws the next bag in series from the roll, through the hole. The new bag is severed from the first along a perforated line of weakness, and stretched in place over the edge of the receptacle.

The trash receptacle need be tilted about its hinge, to reveal the inside of the magazine, only infrequently, when a new roll of bags needs to be installed. Normally, the trash receptacle remains upright, sitting on the seat formed by the flange.

Since the invention is subject to modifications and variations, it is intended that the foregoing description and the accompanying drawings shall be interpreted as illustrative of only one form of the invention, whose scope is to be measured by the following claims.

I claim:

1. A magazine for dispensing liner bags from a supply roll through an aperture in a bottom of a trash receptacle, said magazine comprising an upwardly open base having a horizontal cross-sectional shape adapted to receive the trash receptacle, a hinge for connecting the base to the trash receptacle along a horizontal pivot axis extending along one side of the base, whereby the receptacle can be titled away from the base to provide access to the base without requiring one to reach into the receptacle, and without separating the magazine from the receptacle, and said base having a seat formed by an inwardly protruding flange to limit the depth of penetration of the trash receptacle into the magazine, so that it does not bear against or otherwise interfere with the liner bag supply.

2. The invention of claim 1, wherein the base comprises a floor and two vertical, parallel dividers extending upward from the floor of the base, defining between them a central cavity adapted to receive a roll of liner bags, and two auxiliary cavities, one on either side of the central cavity, providing convenient storage areas for additional rolls of liner bags and supplies.

3. The combination of a trash receptacle and a magazine for dispensing liner bags from a supply roll through an aperture in a bottom of the trash receptcle, said magazine comprising an upwardly open base having a horizontal cross-sectional shaped adapted to receive the trash receptacle, a hinge connecting the base to the trash receptacle along a horizontal pivot axis extending along one side of the base, whereby the receptacle can be tilted away from the base to provide access to the base without requiring one to reach into the receptacle, and without separating the magazine from the receptacle, and said base having a seat formed by an inwardly protruding flange to limit the depth of penetration of the trash receptacle into the magazine, so that it does not bear against or otherwise interfere with the line bag supply.

4. The invention of claim 3, wherein the base comprises a floor and two vertical, parallel dividers extending upward from the floor of the base, defining between them a central cavity adapted to receive a roll of liner bags, and two auxiliary cavities, one on either side of the central cavity, providing convenient storage areas for additional rolls of liner bags and supplies.

* * * * *